United States Patent [19]

Wildersohn et al.

[11] Patent Number: 4,950,414

[45] Date of Patent: Aug. 21, 1990

[54] LUBRICANTS FOR CONTINUOUSLY VARIABLE TRANSMISSIONS

[75] Inventors: Manfred Wildersohn; Siegfried Germann, both of Eschweiler, Fed. Rep. of Germany

[73] Assignee: UK-Mineralolwerke Wenzel & Weidmann, GmbH, Eschweiler, Fed. Rep. of Germany

[21] Appl. No.: 304,778

[22] Filed: Jan. 31, 1989

[30] Foreign Application Priority Data

Feb. 5, 1988 [DE] Fed. Rep. of Germany ..... 3803399

[51] Int. Cl.[5] ..... C10M 137/12; C10M 137/14

[52] U.S. Cl. ..... 252/32.7 E; 252/32.5; 252/78.5

[58] Field of Search ..... 252/32.7 E, 51.5 A, 252/78.5

[56] References Cited

U.S. PATENT DOCUMENTS 4,080,307 3/1978 Schmidt et al. ..... 252/32.7 E 4,670,173 6/1987 Hayashi et al. ..... 252/51.5 A

*Primary Examiner*—William R. Dixon, Jr.

*Assistant Examiner*—Ellen M. McAvoy

*Attorney, Agent, or Firm*—Connolly & Hutz

[57] ABSTRACT

This invention relates to lubricants for continuously variable transmissions, which are particularly advantages for pulling chains.

16 Claims, No Drawings

LUBRICANTS FOR CONTINUOUSLY VARIABLE TRANSMISSIONS

BACKGROUND OF THE INVENTION

It is known to the artisan, that continuously variable transmissions gain in importance, since motor-vehicles equipped with such transmissions have a very good efficiency, low noise level and low fuel consumption.

It has to be distinguished between pushing belt and pulling chains.

A well known pushing belt is for example the CVT-transmission with Van-Doorne pushing belt (Antriebstechnik 26, (1978) Nr. 8, pages 47–52).

Lubricants are of great importance for pulling chains and pushing belts. Lubricants should not only possess good lubricant properties in order to minimize wear at chains, but in addition they must have a specific coefficient of friction. The coefficient of friction must be higher compared to convential lubricants, however not as high as in the case of so-called traction fluids.

In the latter case a coefficient of friction as high as possible is preferred, because the additional property to have good lubrication properties with regard to the chain links is not required, because disks or wheels are in close contact to each other, the percentage of slip of which should be as small as possible. If the speed of rotation of one body is V1 and the speed of rotation of another body is V2, the coefficient of percentage of slip is defined as $$\frac{V1 - V2}{V1}.$$

Lubricants for pulling chains are known in the literature. Thus DE-OS 31 27 970 discloses a lubricant, which consists of a hydrogenation oil, which contains hydrocarbons with 19–30 carbon atoms as well as three six-membered carbocyclic rings.

In DE-OS 33 21 773 a lubricant is described, which contains carbon atom bridges connected by decalin/r-ings.

In DE-OS 33 37 503 a lubricant is disclosed by the same applicant, which also contains hydrogenated condensed aromatic rings.

Phosphetane derivates as additives in conventional lubricants are disclosed in DE-OS 27 15 529.

SUMMARY OF THE INVENTION

The investigations of applicant have led to the non-obvious result that a lubricant, which is very well suited for continuously variable transmissions, in particular for pulling chains is characterized in that it contains 10–80 weight-% of naphthenic hydrocarbons, 80–10 weight-% of polyisobutene with a degree of polymerization of molar weight of 200 to 10.000, preferably of 300 to 6000 and that it contains an additive of at least one of the phosphetane derivates of the general formula

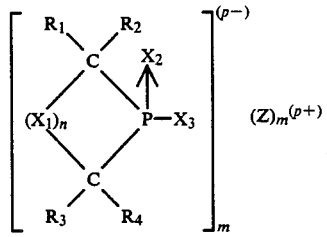

in a quantity of $30\times10^{-6}$ moles to $1\times10^{-2}$ moles, preferably of $1{,}5\times10^{-5}$ to $5\times10^{-3}$ moles and particularly preferably of $3\times10^{-5}$ to $3\times10^{-3}$ moles, based on 100 g of lubricant, whereby $R_1$, $R_2$, $R_3$ and $R_4$ can be H, linear, branched or cyclic saturated $C_1$–$C_4$ hydrocarbon groups, $X_1$, $X_2$ and $X_3$ are independent of each other O (oxygen) or S (sulfur).

n is 1, if $X_1$ is O (oxygen) and 1–6, if $X_1$ is S (sulfur)

Z is a mono- or polyvalent, nitrogen containing, oil soluble organic base m is 1 or 2 and P is 1 or 2.

Preferably $X_1$ is S n is 1–2

$X_2$ and $X_3$ are O (oxygen) and

Z is a primary, secondary or tertiary amine of the formula $N(R_5, R_6, R_7)$, whereby $R_5$ and $R_6$ are independent of each other H (hydrogen) or an aliphatic or aromatic group and $R_7$ is an aliphatic or aromatic group.

Particularly preferable $X_1$ is S n is 1

$X_2$ and $X_3$ are O (oxygen) and

Z is a primary amine of the formula $N(H,H,R_8)$, whereby $R_8$ is an aliphatic group m is 1.

The naphthenic component is a highly refined, resp. hydrogenated product. Such products are available on the market. They may be of course, also be produced in own units.

The polyisobutene component may also be a product available on the market.

The naphthenic component is present in the lubricant in a concentration of 10–80 weight-%, preferably of 15 to 50 weight-%.

The polyisobutene component is present in the lubricant in a concentration of 10 to 80 weight-%, preferably of 40 to 70 weight-%.

The groups at the four-membered ring of the phosphetane derivate $R_1$, $R_2$, $R_3$ and $R_4$ may be the same or different. Preferably they are H, however they may also be $C_1$–$C_4$-hydrocarbon groups, which are linear, branched or cyclic, whereby $X_1$, $X_2$ and $X_3$ are independent of each other O or S n is 1, if $X_1$ is O and is 1–6, if $X_1$ is S Z is a mono- or polyvalent nitrogen containing, oil soluble, organic base, m is 1 or 2 and p is 1 or 2.

Preferably $X_1$ is S n is 1–2

$X_2$ and $X_3$ are O and

Z is a primary, secondary or tertiary amine of the formula (N $R_5$, $R_6$, $R_7$), whereby $R_5$ and $R_6$ are independent of each other H, or an aliphatic or aromatic group and $R_7$ is an an aliphatic or aromatic group.

Particularly preferable $X_1$ is S n is 1

$X_2$ and $X_3$ are O (oxygen)

Z is a primary amine of the formula N(H, H, $R_3$), whereby $R_3$ is an aliphatic group and m is 1.

PREFERRED EMBODIMENT

As a base for salt formation with 1,3-thiaphosphetanes basically any mono- or diavalent organic nitrogen base may be used.

For practical reason only oil soluble nitrogen bases and in particular those with a total number of C-atoms of 6–40 are suitable for the application in lubricants. Preferred oil soluble, organic nitrogen base are monovalent compounds and in particular primary, secondary or tertiary amines of the formula N($R_5$, $R_6$, $R_7$), whereby $R_5$ and $R_6$ are independent of each other hydrogen or an aliphatic or aromatic group and $R_7$ is an aliphatic or aromatic group.

If $R_5$, $R_6$ and $R_7$ are an aliphatic group, these groups may be, optionally interrupted by O and/or S, branched or linear alkyl like methyl, ethyl, n-propyl, n-isopropyl, tert.-butyl, amyl, hexyl, 1-methylpentyl, tert.-octyl, 2-ethylhexyl, n-decyl, 2-ethyldecyl, n-tetradecyl, n-octadecyl, n-eicosyl, 2,7,8-trimethyldecyl, 4-isobutyl-2,5-dimethylheptyl, octacosoyl, dodecatriacontyl, hexatriacontyl, or tetracontyl.

However $R_5$, $R_6$ and $R_7$ as aliphatic groups may optionally be interrupted by O or S, and may also be linear or branched alkenyl like aryl, vinyl, 2-butenyl, 2-hexenyl, 2-dodecenyl or 2-hexatriacontenyl.

The total number of C-atoms in the groups $R_5$, $R_6$ and $R_7$ is preferably 6 to 40.

The amino group may optionally be ethoxylated, whereby the degree of ethoxylation has to be adjusted to the desired oil solubility of the product.

If $R_5$, $R_6$ and $R_7$ are aromatic groups, they may be optionally phenyl groups, substituted by alkyl groups with 1 to 12 C-atoms, like methyl, ethyl, propyl, butyl, hexyl, octyl, decyl, or dodecyl.

Among the organic nitrogen bases to be used of the formula N($R_5$, $R_6$, $R_7$), those are to be mentioned, wherein $R_5$ and $R_6$ are independent of each other hydrogen or aliphatic groups and $R_7$ is a phenyl group, optionally substituted by alkyl groups.

Particularly preferred are primary, organic nitrogen bases of the formula N(H, H, $R_8$), whereby $R_8$ may, optionally be interrupted by oxygen or sulfur, be linear or branched alkyl or alkenyl groups with 6 to 40 carbon atoms, preferably with 8 to 24 carbon atoms.

In practical application blends of different nitrogen bases may be used, like for example "Primene 81-R (blend of primary $C_{12}$–$C_{15}$-tert.-alkylamines of Rohm and Haas, U.S.A.). Also well suited are salts with a particular nitrogen component.

Examples for amine are:

methyl amine, ethyl amine, propyl amine, butyl amine, tert.-butyl amine, hexyl amine, octyl amine, (2-ethylhexyl) amine, tert.-octyl amine, decyl amine, tert.-dodecyl amine, tetradecyl amine, octadecyl amine, phenyl amine, benzyl amine, (nonylphenyl) amine, cyclohexyl amine, pyridine, piperidine, dimethyl amine, methyloctyl amine, didodecyl amine, methyloctadecyl amine, methylcyclohexyl amine, phenyloctyl amine, trimethyl amine, dimethylcyclohexyl amine, methyloctyldecyl amine, (octoxethyl) amine, (octylthioethyl) amine, (tert.-dodecylthioethyl) amine, dodecyl-dimethyl amine, hexadecyl-dimethyl amine, decyl-dimethyl amine, didodecyl-methyl amine, methyl-butyl-dodecyl amine, dimethyl-propyl amine, trioctyl amine, dioctylmethyl amine, dodecyl-benzyl-methyl amine, nonylphenyl-dimethyl amine, phenyl-dodecyl-methyl amine, phenyl-dimethyl amine, allyl-dibutyl amine, methyl-dodecyl amine, heptadecyl-dimethyl amine, dioctyl-methyl amine, methyl-α-naphthyl-phenyl amine, cyclohexyl-dimethyl amine, nonyl-dimethyl amine, tris (n-tridecyl) amine, tris (n-dodecyl) amine, tris (isooctyl) amine, methyl-butyl-hexadecyl amine, tri-ethyl amine, 3,5-dimethylpyridine, 2-(ethylhexyl)-methyl-dodecyl amine, (methylethyl)-didecyl amine, methyl-butyl-dodecyl amine, dimethyl dodecyl amine, hexadecyl-dimethyl amine, tris (i-dodecyl) amine, dimethyl-benzyl amine, dimethyl-(tert.-octylphenyl) amine, (N-methyl)-1-imidazoline, (N-methyl)-1-pyrrazoline, oxazoline, chinoline, pyrrolidine, N-ethyl-pyrrolidine, N-methyl-piperidine, N-butyl-piperidine, thiazole, N-methyl-phenothiamine.

Examples but not limitating for inventive phosphetanes are:

dodecylammonium salt of 3-hydroxy-3-oxo-1,3-thiaphosphetane, di-n-butylammonium salt of 3-mercapto-3-thio-1,3-thiaphosphetane, tri-n-octylammonium salt of 3-hydroxy-3-oxo-1,3-thiaphosphetane, (2,6-di-tert.-butyl-phenyl) ammonium salt of 3-mercapto-3-oxo-1,3-oxaphosphetane, (2,6-diethyl-phenyl)-diethyl ammonium salt of 3-hydroxy-3-oxo-1,3-thiaphosphetane, tri-n-nonyl ammonium salt of 3-hydroxy-3-oxo-1,3-oxaphosphetane, di-(2-ethyl-hexyl) ammonium salt of 3-hydroxy-3-oxo-1,3-thiaphosphetane.

According to the invention one or several of the phosphetane derivatives disclosed can be applied.

The investigations of applicant have led to the surprising and non-obvious result that wear at the chains is strongly reduced by application of the inventive lubricants. Thus the inventive blend represents a lubricant, which not only yields the desired coefficient of friction, but also reduces wear of chains.

The inventive lubricants have been thoroughly tested on a CVT gear testing stand and also by numerous tests in motor-vehicles.

The test gear (transmission) was filled before start of the test with approx. 5 l of test oil.

Between the tests, the test-device was thoroughly cleaned and rinsed subsequently with 1,5 l of the new test-lubricant.

After 3000 KWh respectively (corresponding to a 12.000 km test run), 50 ccm of lubricant were withdrawn and substituted by the same quantity of fresh lubricant.

Each starting cycle lasted up to 1 minute, corresponding to approx. 1 km of driving distance.

Tests were carried out with driving distances of 12.000,24.000 and 38.000 km.

The starting cycle was chosen in such a way, that chain and cone pulley were exposed to the highest possible load by continues shifting, shut-off shifting and correspondingly to high slip portions.

Applied to a motor-vehicle, the motor-vehicle was started with jumping clutch at medium number of revolutions and medium nominal momentum and quickly accelerated to a velocity of approx. 120 km/h.

Subsequently full breaking was carried out accompagnied by readjustment of the conversion transmission into the starting gear.

Evaluation criteria for the lubricant tested, were wear at the pressure pieces employed, formation of gray stain at the cone pulleys and the coefficient of friction.

A typical lubricant formulation contains the following components:

| | |
|---|---|
| polyisobutene | 65 weight-% |
| naphthenic oil | 20 weight-% |
| phosphetane derivative | 0,03 weight-% |
| additional additives | 14,97 weight-% |

The latter are essentially viscosity improvers like for example polymethacrylates, antifoam agents, corrosion inhibitors and antioxidants, like for example phenol- and/or amine derivates.

Furthermore it is advantegeous to add antiwear additives, for example on the basis of phosphorus and/or sulfur.

Additives, which are available on the market can be used according to the invention but also other products.

Phosphetane derivative

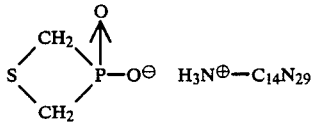

lead to the following results:

TABLE 1

| | total energy transferred (KWh) | wear (mg) | gray stain | friction coefficient ($\mu$) |
|---|---|---|---|---|
| Sample I ATF | 8198 | 32 | none | 0,128–0,149 |
| Sample II ATF | 7841 | 58 | none | |
| Sample III (according to the invention) | 7896 | 6 | none | 0,127–0,140 |
| Sample IV (like III, however without phosphetane) | 7955 | 35 | none | 0,105 |

(ATF = conventional automatic transmission fluid).

Table 1 shows that in the case of sample III an optimum friction coefficient is observed combined with a surprising wear reduction.

Without addition of the phosphetane derivative sample IV, which corresponds to blend III, exhibits neither a satisfactory wear coefficient nor a satisfactory friction coefficient.

Appearance of cone pulleys with addition of phosphetane derivatives shows no gray stain.

Viscosity performance

Three samples were tested with performance in kilometers:

a, 13.000 km
b, 25.000 km
c, 38.000 km

TABLE 2

| | Fresh oil | Sample a | Sample b | Sample c |
|---|---|---|---|---|
| viscosity at 40° C. in $mm^2/s$ | 50,7 | 44 | 42,5 | 14,6 |
| vicosity at 100° C. in $mm^2/s$ | 8,5 | 7,1 | 6,9 | 6,65 |
| VIE (viscosity index) | 143 | 122 | 120 | 113 |
| NZ (coefficient of neutralization) | 1,11 | | | 1,15 |
| VZ (saponification number) | 2,58 | | | 3,36 |

The results clearly show that the inventive lubricants have an excellent shearing strength.

Neutralization and saponification coefficient show that oil aging is very low.

TABLE 3

| | Sample a | Sample b | Sample c |
|---|---|---|---|
| Cu ppm | 2 | 2 | 3 |
| Fe ppm | 28 | 29 | 32 |

Table 3 shows that the increase of concentration of Cu and Fe is almost negligible. This result shows that the inventive additives guarantee an excellent wear resistance.

Correspondingly motor-oil change has to be carried out only after at least 40.000 km of driving distance.

In addition concentrations of Pb, Si, Mn, Mo, Ca, Zn, Ni, Al, Cr, B, P, Mg, Ba, and Sn were examined.

No changes in concentration were observed compared to fresh oil.

The inventive lubricant compositions were tested within the limits of the claims disclosed, whereby numerous phosphetane derivatives were prepared according to DE-OS 27 15 529 and the literature disclosed in this application. These tests lead to similar, excellent results.

Only a few of the blends investigated, are disclosed in table 4.

TABLE 4

| Sample Nr. | $R_1$ | $R_2$ | $R_3$ | $R_4$ | $X_1$ | $X_2$ | $X_3$ | Z | p | n | m |
|---|---|---|---|---|---|---|---|---|---|---|---|
| 1 | H | $CH_3$ | $C_2H_5$ | H | S | O | O | A | 1 | 1 | 1 |
| 2 | H | $C_3H_7$ | H | H | S | O | O | B | 1 | 1 | 1 |
| 3 | H | H | H | H | S | O | O | A | 1 | 2 | 1 |
| 4 | H | $C_4H_9$ | H | H | O | S | S | C | 1 | 1 | 1 |

A = $N(C_2H_5)_2C_8H_{17}$
B = $N(CH_3)_2C_{12}H_{25}$

C = 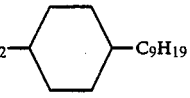

| ½ Polyisobutene 75 weight % Naphthenic oil 15 weight % Phosphetane 1/100 moles Additives to 100% | ¾ Polyisobutene 30 weight % Naphthenic oil 58 weight % Phosphetan 1/10000 moles and 1/100000 moles Additives to 100% |
|---|---|

Results

| Sample Nr. | Total energy transferred (KWh) | wear (mg) | gray stain | friction coefficient ($\mu$) |
|---|---|---|---|---|
| 1 | 8220 | 3 | none | 0,127–0,140 |
| 2 | 7975 | 2 | none | 0,128–0,142 |

TABLE 4-continued

| | | | | |
|---|---|---|---|---|
| 3 | 8115 | 5 | none | 0,127–0,142 |
| 4 | 8234 | 15 | none | 0,118–0,136 |

Performance test: 38.000 km

| Sample Nr. | Viscosity at 40° C. in $mm^2/s$ | Viscosity at 100° C. in $mm^2/s$ | Viscosity index | Coefficient of neutralization | Saponification number | Cu ppm | Fe ppm |
|---|---|---|---|---|---|---|---|
| 1 | 16,9 | 6,9 | 120 | 1,13 | 2,95 | 2 | 28 |
| 2 | 16,2 | 7,0 | 118 | 1,13 | 2,99 | 2 | 29 |
| 3 | 14,3 | 6,3 | 116 | 1,15 | 3,40 | 2 | 31 |
| 4 | 13,9 | 6,0 | 109 | 1,13 | 3,51 | 4 | 34 |
| Fresh oil | 50,5 | 8,4 | 144 | 1,12 | 2,59 | — | — |

We claim:

1. Lubricant, characterized in that it contains 10–80 weight-% of naphthenic hydrocarbons, 80–10 weight-% of polyisobutene with a degree of polymerization of molar weight of 200 to 10,000, and that it contains an additive of at least one of the phosphetane derivates of the general formula

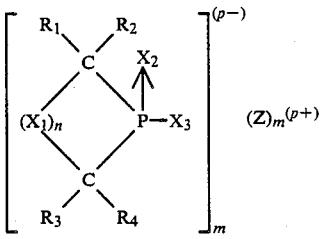

in a quantity of $1.5\times10^{-5}$ moles to $1\times10^{-2}$ moles, 1.5, based on 100 g of lubricant, whereby $R_1$, $R_2$, $R_3$ and $R_4$ can be H, linear, branched or cyclic saturated $C_1$–$C_4$ hydrocarbon groups, $X_1$, $X_2$ and $X_3$ are independent of each other O (oxygen) or S (sulfur), n is 1, if $X_1$ is O (oxygen) and 1–6, if $X_1$ is S (sulfur)

Z is a mono- or polyvalent, nitrogen containing, oil soluble, organic base m is 1 or 2 and P is 1 or 2.

2. Lubricant according to claim 1, characterized in that $R_1$, $R_2$, $R_3$ and $R_4$ are H.

3. Lubricant according to claim 1, characterized in that the naphthenic oil is hydrogenated.

4. Lubricant according to claim 1, characterized in that the degree of polymerization of the polyisobutene corresponds to a molar weight of 300 to 6000.

5. Lubricant according to claim 1, characterized in that the concentration of the naphthenic oil is 15–50 weight-%.

6. Lubricant according to claim 1, characterized in that the concentration of the polyisobutene is 40–70 weight-%.

7. Lubricant according to claim 1, characterized in that the concentration of the phosphetane derivative(s) is $1.5\times10^{-5}$ to $5\times10^{-3}$ moles based on 100 g of lubricant.

8. Lubricant according to claim 1, characterized in that the concentration of the phosphetane derivative(s) is $3\times10^{-5}$ to $3\times10^{-3}$ moles based on 100 g of lubricant.

9. Lubricant according to claim 1, characterized in that it contains in addition a viscosity improver.

10. Lubricant according to claim 1, characterized in that it contains in addition an anti-foaming agent.

11. Lubricant according to claim 1, characterized in that it contains in addition an anti-corrosion agent.

12. Lubricant according to claim 1, characterized in that it contains in addition an anti-wear agent.

13. Lubricant according to claim 1 wherein for said formula $X_1$ is S, n is 1–2, $X_2$ and $X_3$ are oxygen and Z is a primary, secondary or tertiary amine of the formula $N(R_5, R_6, R_7)$, wherein $R_5$ and $R_6$ are, independently of each other, hydrogen, an aliphatic group or an aromatic group and $R_7$ is an aliphatic or aromatic group.

14. Lubricant according to claim 1 wherein for said formula, $X_1$ is S, n is 1, $X_2$ and $X_3$ are oxygen and Z is a primary amine of the formula $N(H, H, R_8)$, wherein $R_8$ is an aliphatic group and m is 1.

15. A transmission fluid composition for continuously variable mechanical transmissions which comprises the lubricant according to claim 1.

16. A transmission fluid composition for pulling chain transmissions which comprises the lubricant according to claim 1.

* * * * *